US005310613A

United States Patent [19]

Pai et al.

[11] Patent Number: 5,310,613

[45] Date of Patent: May 10, 1994

[54] HIGH SENSITIVITY VISIBLE AND INFRARED PHOTORECEPTOR

[75] Inventors: Damodar M. Pai, Fairport; Santokh S. Badesha, Pittsford; John F. Yanus; Michael J. Rice, both of Webster, all of N.Y.

[73] Assignee: Xerox Corporation, Stamford, Conn.

[21] Appl. No.: 808,391

[22] Filed: Dec. 16, 1991

[51] Int. Cl.[5] ..... G03G 5/047

[52] U.S. Cl. ..... 430/59; 430/58

[58] Field of Search ..... 430/58, 59

[56] References Cited

U.S. PATENT DOCUMENTS

| | | | |
|---|---|---|---|
| 4,265,990 | 5/1981 | Stolka et al. | 430/59 |
| 4,618,551 | 10/1986 | Stolka et al. | 430/58 |
| 4,664,997 | 5/1987 | Suzuki et al. | 430/58 |
| 4,725,519 | 2/1988 | Suzuki et al. | 430/58 |
| 4,758,488 | 7/1988 | Johnson et al. | 430/58 X |
| 4,772,525 | 9/1988 | Badesha et al. | 430/58 |
| 4,774,159 | 9/1988 | Stolka et al. | 430/58 |
| 4,801,517 | 1/1989 | Frachet et al. | 430/59 |
| 4,806,443 | 2/1989 | Yanus et al. | 430/56 |
| 4,806,444 | 12/1989 | Yanus et al. | 430/56 |
| 4,818,650 | 4/1989 | Limburg et al. | 430/56 |
| 4,842,970 | 6/1989 | Tai et al. | 430/58 |
| 4,847,175 | 7/1989 | Paulisko et al. | 430/58 |
| 4,882,427 | 11/1989 | Enokida et al. | 540/141 |
| 4,898,799 | 2/1990 | Fujimaki et al. | 430/59 |
| 4,935,487 | 6/1990 | Yanus et al. | 528/203 |
| 4,956,440 | 9/1990 | Limburg et al. | 528/99 |
| 5,028,687 | 7/1991 | Yanus et al. | 528/203 |
| 5,030,532 | 7/1991 | Limburg et al. | 430/56 |

*Primary Examiner*—Roland Martin

[57] ABSTRACT

An electrophotographic imaging member including a charge generating layer containing a dispersed oxytitanium phthalocyanine polymorph and a charge transport layer containing a film forming charge transporting polymer including charge transporting moieties in the backbone of the film forming charge transporting polymer, for example, polysilylenes and polyarylamine derivative. The charge transporting polymers may optionally be used as a binder in the charge generating layer. The imaging member may be employed in an electrophotographic imaging process, particularly in high sensitivity infrared photoreceptors which are compatible with liquid ink development processes.

18 Claims, No Drawings

HIGH SENSITIVITY VISIBLE AND INFRARED PHOTORECEPTOR

BACKGROUND OF THE INVENTION

This invention relates in general to electrophotographic imaging members and more specifically, to imaging members comprising titanyl phthalocyanine and charge transporting polymer components.

One common type of electrophotographic imaging member or photoreceptor is a multilayered device that comprises a conductive layer, an optional charge blocking layer, an adhesive layer, a charge generating layer, and a charge transport layer. Either the charge generating layer or the charge transport layer may be located adjacent the conductive layer. The charge transport layer can contain an active aromatic diamine small molecule charge transport compound dissolved or molecularly dispersed in a film forming binder. This type of charge transport layer is described, for example in U.S. Pat. No. 4,265,990. Although excellent toner images may be obtained with such multilayered photoreceptors, it has been found that when high concentrations of active aromatic diamine small molecule charge transport compound are dissolved or molecularly dispersed in a film forming binder, the small molecules tend to crystallize with time under conditions such as higher machine operating temperatures, mechanical stress or exposure to chemical vapors. Such crystallization can cause undesirable changes in the electro-optical properties, such as residual potential build-up which can cause cycle-up. Moreover, the range of binders and binder solvent types available for use during coating operations is limited when high concentrations of the small molecules are sought for the charge transport layer. For example, active aromatic diamine small molecules do not disperse in polyurethane binders. Limited selection of binders and binder solvents can affect the life and stability of a photoreceptor under extended cycling conditions. Moreover, such limited selection also affects the choice of binders and solvents used in subsequently applied layers. For example, the solvents employed for subsequently applied layers should not adversely affect any of the underlying layers. This solvent attack problem is particularly acute in dip coating processes. Further, some of the solvents that are commonly utilized, such as methylene chloride, are marginal solvents from the point of view of environmental toxicity. Although excellent toner images may be developed with multilayer photoreceptors in machines that employ dry developer powder or toners, it has been found that these same photoreceptors become unstable when employed with liquid development systems. These photoreceptors suffer from cracking, crazing, extraction, phase separation and crystallization of charge transporting active compounds by contact with the organic carrier fluid in a machine employing a liquid development system. A commonly employed organic carrier fluid in liquid development systems is an isoparaffinic hydrocarbon, for example, Isopar® available from Exxon Chemicals International, Inc. The leaching and crystallization of charge transporting active compounds markedly degrades the mechanical integrity and electro-optical performance of the photoreceptors. More specifically, the organic carrier fluid of a liquid developer leaches out activating small molecules, such as the arylamine containing compounds typically used in the charge transport layers. Representative of this class of materials are:

N,N'-diphenyl-N,N'-bis(3-methylphenyl)-[1,1'-biphenyl]-4,4'-diamine; bis-(4-diethylamino-2-methylphenyl)-phenylmethane; 2,5-bis-(4'-diethylamino phenyl)-1,3,4-oxadiazole; 1-phenyl-3-(4'-diethylaminostyryl)-5-(4''-diethylaminophenyl)-pyrazoline; 1,1-bis-(4-(di-N,N'-p-methylphenyl)-aminophenyl)-cyclohexane;4-diethylaminobenzaldehyde-1,1-diphenylhydrazone; 1,1-diphenyl-2(p-N,N-diphenylamino phenyl)-ethylene. The leaching process results in crystallization of the charge transporting activating small molecules, such as the aforementioned arylamine compounds, onto the photoreceptor surface and subsequent migration of the arylamine into the liquid developer ink. In addition, the ink vehicle, typically a $C_{10}$–$C_{14}$ branched hydrocarbon, induces the formation of cracks and crazes in the photoreceptor leading to the onset of copy defects and shortened photoreceptor life. Sufficient degradation can occur in less than eight hours of use making these photoreceptors unsuitable for use in machines employing liquid developers.

Another type of charge transport layer has been developed which utilizes a charge transporting polymer. This type of charge transport polymer includes materials such as poly N-vinyl carbazole, polysilylenes, and others including those described in U.S. Pat. Nos. 4,806,443, 4,806,444, 4,818,650, 4,935,487, and 4,956,440. Other charge transporting materials include polymeric arylamine compounds and related polymers described in U.S. Pat. Nos. 4,801,517, 4,806,444, 4,818,650, 4,806,443, and 5,030,532, copending application Ser. No. 797,753, entitled "ELECTROPHOTOGRAPHIC IMAGING MEMBER", mailed by Express Mail on Nov. 25, 1991, in the name of Yanus et al, and copending application Ser. No. 798,363, entitled "ELECTROPHOTOGRAPHIC IMAGING MEMBERS CONTAINING POLYARYLAMINE POLYMERS", mailed by Express Mail on Nov. 25, 1991, in the name of Yanus et al, the disclosures of which are incorporated herein by reference in their entirety. Some polymeric charge transporting materials have relatively low charge carrier mobilities. Mechanical properties of these pendant type polymers, such as poly N-vinyl carbazole and polystyryl anthracene, is less than adequate for photoreceptor belt fabrication and operation. Moreover, charge transporting polymers having high concentrations of charge transporting moieties in the polymer chain can be very costly. Further, the mechanical properties of charge transporting polymers such as wearability, hardness and craze resistance are reduced when the relative concentration of charge transporting moieties in the chain is increased.

Phthalocyanines have been employed as photogenerating materials for use in both visible and infrared radiation exposure machines. Infrared sensitivity is a requirement if semiconductor lasers are employed as the exposure source. The absorption spectrum and photosensitivity depend on the central metal atom. Many metal phthalocyanines have been reported. These include, oxyvanadium phthalocyanine, chloroaluminum phthalocyanine, copper phthalocyanine, oxytitanium phthalocyanine, chlorogallium phthalocyanine, magnesium phthalocyanine and metal-free phthalocyanine. Some of these phthalocyanines exist in many crystal forms. Even with the same central metal atom, the absorption spectrum and sensitivity may depend on crystal structure and morphology.

The photogenerating layer contains a bichromophoric photogenerating compound, for example a phthalocyanine pigment compound, or a mixture of two or more phthalocyanine pigment compounds. Generally, this layer has a thickness of from about 0.05 micrometer to about 10 micrometers or more, and preferably has a thickness of from about 0.1 micrometer to about 3 micrometers. The thickness of this layer, however, is dependent primarily upon the concentration of photogenerating material in the layer, which may generally vary from about 5 to 100 weight percent. When the photogenerating material is present in a binder material, the binder preferably contains from about 30 to about 95 percent by weight of the photogenerating material, and preferably contains about 80 percent by weight of the photogenerating material. Generally, it is desirable to provide this layer in a thickness sufficient to absorb about 90 percent or more of the incident radiation which is directed upon it in the imagewise or printing exposure step. The maximum thickness of this layer is dependent primarily upon factors such as mechanical considerations, such as the specific photogenerating compound selected, the thicknesses of the other layers, and whether a flexible photoconductive imaging member is desired.

The sensitivity of a layered device depends on several factors: (1) the fraction of the light absorbed, (2) the efficiency of photogeneration within the pigment crystals, (3) the efficiency of injection of photogenerated holes into the transport layer and (4) the distance the injected carrier travels in the transport layer between the exposure and development steps. The fraction of the light absorbed can be maximized by the employment of adequate concentration of pigment in the generator layer and the thickness of the generator layer. The distance the carrier travels in the transport layers can be optimized by the selection of the transporting material and on the concentration of the charge transporting active molecules in the case of transport layers consisting of a dispersion of transport active molecules in a non-transporting inactive binder. However the efficiency of photogeneration and injection can be interactive in that both processes depend on both the pigment and the transport material. There are at least two reasons for this interactive dependence. The photogeneration efficiency with some pigments depends upon the presence of the transporting material on the surface of the pigment. Devices fabricated employing these pigments may be sensitive with transport layers employing active molecules dispersed in an inactive binder material but may be very much less sensitive when employed in conjunction with transport layers consisting of charge transporting polymers. This dependence arises in the case where the transport layer consists of active molecules dispersed in an inactive binder (herein termed small molecule transport layer), from the active molecules penetrating the generator layer during the fabrication of the transport layer. This is not the case when the transport layer consists of a charge transporting polymer. Therefore there is no certainty that a pigment that seems sensitive in a device employing small molecule transport layer will have good sensitivity when employed in conjunction with a charge transporting polymer. Interactive dependence of injection efficiency can also be related to ionization potential matching of the constituent charge transport molecules and the charge generating pigment or pigments. For layered devices employing hole photogeneration and transport, the ionization potential of the charge transport layer material ($IP_{CTL}$) has to be smaller than the ionization potential of the charge generating pigment ($IP_{CGP}$) to ensure maximum injection efficiency. That is, $IP_{CTL} < IP_{CGP}$.

Thus, in imaging systems utilizing multilayered photoreceptors containing generator layers employing some pigments and charge transporting polymers in the transport layers, loss of sensitivity may result from the active transport species not physically penetrating the generator layer or as a result of an ionization potential mismatch. Reduced sensitivity can reduce the practical value of multilayered photoreceptors for use in high speed electrophotographic copiers, duplicators and printers.

INFORMATION DISCLOSURE STATEMENT

U.S. Pat. No. 4,664,997 to Suzuki et al., issued, May 12, 1987 —discloses a photoreceptor comprising a charge generation layer comprising oxytitanium phthalocyanine dispersed in a binder polymer, and a charge carrier transport layer. The charge carrier transport layers are either pendant type charge transport polymers containing heterocyclic group or polycondensed aromatic group on the side chain or monomeric heterocyclic compounds dispersed in an inactive binder. The pendant type polymers are of the type poly-N-vinyl carbazole and polystyryl anthracene. See column 7, line 46 to column 8, line 5. These are pendant polymers and are believed to have poor mechanical properties.

U.S. Pat. No. 4,725,519 to Suzuki et al., issued Feb. 16, 1988—discloses a dual layer photoreceptor comprising a charge generation layer comprising a titanium phthalocyanine compound and a charge transport layer comprising a binder polymer. The charge transport layer comprises a polymer or copolymer of a vinyl compound, polyester, polycarbonate, polysulfone, polyvinyl butyral, phenoxy resin, cellulose resin, urethane resin, or epoxy resin.

U.S. Pat. No. 4,882,427 to Enokida et al., issued Nov. 21, 1989—discloses an electrophotographic plate comprising a charge generating layer and a charge-transferring layer on an electrically conductive substrate. The charge generating layer is comprised of noncrystalline and/or pseudo-non-crystalline titanium phthalocyanine. The titanium phthalocyanine is enhanced by adding a phthalocyanine derivative having oxytitanium in the core. The charge transferring layer is comprised of a donor or acceptor monomer dispersed in a polymeric binder or a pendant type polymer. See column 10, lines 32–40. The pendant polymers are believed to have poor mechanical properties.

U.S. Pat. No. 4,898,799 to Fujimaki et al., issued Feb. 6, 1990—discloses a photoreceptor comprising a carrier generating substance of titanyl phthalocyanine.

U.S. Pat. No. 4,842,970 to Tai et al., issued Jun. 27, 1989—discloses an electrophotographic plate comprising an electroconductive substrate and a photoconductive layer formed thereon. The photoconductive layer is comprised of a charge transporting layer and a charge generating layer comprising a naphthalocyanine compound of a formula as disclosed in column 2, line 28–68. The compound is comprised of a metal, metal oxide, or metal halide which may include Cu, Zn, OTi, OV, ClAl, ClGa, ClIn, $Cl_2Ge$, and $Cl_2Sn$. The charge transporting layer is comprised of macromolecular compounds and low molecular compounds. See column 4, line 58—column 5, line 14.

U.S. Pat. No. 4,847,175 to Pavlisko et al. issued Jul. 11, 1989—discloses an electrophotographic imaging element comprising charge generation materials and charge transporting materials dispersed in a polymeric binder matrix. The charge generation material is comprised of a photoconductive pigment, particularly a phthalocyanine pigment.

U.S. Pat. No. 4,806,443 to Yanus et al., issued Feb. 21, 1989—An electrophotographic imaging member and an electrophotographic process are disclosed in which the imaging member comprises a polymeric arylamine compound represented by a specific formula. The imaging member may comprise a substrate, charge generation layer and a charge transport layer. Activating small molecules such arylamine containing compounds are disclosed, for example, in columns 2 through 4. Part or all of the transport material comprising a hole transporting small molecule in an inactive binder to be employed in a transport layer may be replaced by active polymeric arylamine compounds as disclosed, for example, in column 17, lines 45 through 55.

U.S. Pat. No. 4,818,650 to Limburg et al, issued Apr. 4, 1989—An electrostatographic imaging member and electrostatographic imaging process are disclosed in which the imaging member comprises a polymeric arylamine compound represented by a specific formula. Various activating small molecules are described, for example, in columns 2 through 4. Polymeric arylamine molecules are mentioned in column 3. Part or all of the transport material comprising a hole transporting small molecule in an inactive binder or a transport may be replaced by a polymeric arylamine film forming material as described, for example, in column 26, lines 11 through 21.

U.S. Pat. No. 4,806,444 to Yanus et al., issued Feb. 21, 1989—An electrostatographic imaging member and electrostatographic imaging process are disclosed in which the imaging member comprises a polymeric arylamine compound represented by a specific formula. Various activating small molecule materials are described, for example in columns 2 through 4. Also, polymeric arylamine compounds are mentioned in column 3. Parts or all of the transport material comprising a hole transporting small molecule in an inactive binder for a transport layer may be replaced by active polymeric arylamine compounds as described, for example, in column 17, lines 23 through 33.

U.S. Pat. No. 4,935,487 to Yanus et al., issued Jun. 19, 1990—A polymeric arylamine having a specific formula is disclosed. Various activating small molecule materials such as arylamine compounds are described, for example in columns 2 through 4. Polymeric arylamine molecules are mentioned in column 3. Part or all of the transport material comprising a hole transporting small molecule in an inactive binder for a transport layer may be replaced by active polymeric arylamine film forming material as described, for example, in column 16, lines 20 through 30.

U.S. Pat. No. 4,956,440 to Limburg et al., issued Sep. 11, 1990—Polymeric tertiary arylamine compounds of the phenoxy resin type are disclosed for electrophotographic imaging. Various activating small molecule materials such as arylamine compounds are described, for example in columns 2 through 4. Polymeric arylamine molecules are mentioned in column 3. Part or all of the transport material comprising a hole transporting small molecule in an inactive binder for a transport layer may be replaced by polymeric tertiary arylamine compounds of the phenoxy resin type as described, for example, in column 24, lines 44 through 54.

U.S. Pat. No. 4,801,517 to Frechet et al., issued Jan. 31, 1989—An electrostatographic imaging member and electrostatographic process are disclosed in which the imaging member comprises a polymeric arylamine compound having a specific formula. Various activating small molecule materials such as arylamine compounds are described, for example in columns 2 through 4. Polymeric arylamine molecules are mentioned in column 3. Part or all of the transport material comprising a hole transporting small molecule in an inactive binder for a transport layer may be replaced by the polymeric amine compound, e.g., see column 17, lines 1 through 11.

U.S. Pat. No. 5,028,687 to Yanus et al., issued Jul. 2, 1991—A polymeric arylamine having a specific formula is disclosed. The material is useful in fabricating a charge transport layer of photosensitive members, for example in Example V, column 21, line 21.

U.S. Pat. No. 5,030,532 to Limburg et al, issued Jul. 9, 1991—A polymeric arylamine having a specific formula is disclosed. The material is useful in fabricating a charge transport layer of photosensitive members.

In copending application Ser. No. 797,753, entitled "ELECTROPHOTOGRAPHIC IMAGING MEMBER", filed in the name of Yanus et al, mailed to the U.S. Patent and Trademark Office by Express Mail on Nov. 25, 1991, a polymeric arylamine having a specific formula is disclosed. The material is useful in fabricating a charge transport layer of photosensitive members.

In copending application Ser. No. 798,303, entitled "ELECTROPHOTOGRAPHIC IMAGING MEMBERS CONTAINING POLYARYLAMINE POLYMERS", filed in the name of Yanus et al, mailed to the U.S. Patent and Trademark Office by Express Mail on Nov. 25, 1991, a polymeric arylamine having a specific formula is disclosed. The material is useful in fabricating a charge transport layer of photosensitive members.

Very high sensitivity and excellent toner images are obtained with multilayered photoreceptors in which the charge generator layer comprises various polymorphs of oxytitanium phthalocyanine and transport layers comprises active molecules dispersed in an inactive binder. However, it has been found that if they are operated in a machine employing a liquid development system, the active molecules are leached out of the imaging member of the liquid carrier vehicle resulting in phase separation, crystallization and general degradation of the mechanical and electrical properties of the imaging member. The copy quality is adversely affected thereby limiting the life of the device. On the other hand, the layered devices employing transporting polymers of the prior art are not sensitive enough to be operated in high speed printers employing solid state semiconductor diodes. Also, the devices of the prior art have very poor wear resistance and therefore substantial wear results from interactions with abrasive developer material and cleaning systems. Thus, there is a continuing need for electrophotographic imaging members having improved sensitivities and resistance to the effect of liquid toner vehicle.

SUMMARY OF THE INVENTION

It is, therefore, an object of the present invention to provide an improved electrophotographic imaging member which overcomes the above-noted disadvantages.

It is another object of the present invention to provide an electrophotographic imaging member which avoids crystallization when operated in an environment employing liquid ink development.

It is still another object of the present invention to provide an electrophotographic imaging member exhibiting improved imaging operation during extended image cycling.

It is yet another object of the present invention to provide an electrophotographic imaging member possessing improved integrity of layers underlying the charge transport layer.

It is another object of the present invention to provide an electrophotographic imaging member that exhibits high charge carrier mobilities.

It is still another object of the present invention to provide an electrophotographic imaging member that exhibits greater wearability, hardness and craze resistance with high concentrations of charge transporting moieties in a charge transporting polymer.

It is yet another object of the present invention to provide an electrophotographic imaging member which can be coated employing a variety of solvents.

It is still another object of this present invention to provide an electrophotographic imaging member with very high sensitivities in both the visible and infrared regions of the electromagnetic spectrum.

The foregoing objects and others are accomplished in accordance with this invention by providing an electrophotographic imaging member comprising a charge generator layer comprising a polymorph of oxytitanium phthalocyanine or structural derivative thereof, and a charge transport layer, the charge transport layer comprising a charge transporting polymer in which the charge is transported through the active moieties incorporated in the backbone of the charge transporting polymer. This imaging member may be employed in an electrophotographic imaging process.

Electrostatographic imaging members are well known in the art. Electrostatographic imaging members may be prepared by various suitable techniques. Typically, a flexible or rigid substrate is provided having an electrically conductive surface. A charge generating layer is then applied to the electrically conductive surface. A charge blocking layer may be applied to the electrically conductive surface prior to the application of the charge generating layer. If desired, an adhesive layer may be utilized between the charge blocking layer and the charge generating layer. Usually the charge generation layer is applied onto the blocking layer and a charge transport layer is formed on the charge generation layer. However, in some embodiments, the charge transport layer is applied prior to the charge generation layer.

The substrate may be opaque or substantially transparent and may comprise numerous suitable materials having the required mechanical properties. Accordingly, the substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like which may be rigid or flexible. The electrically insulating or conductive substrate may be in the form of an endless flexible belt, a web, a rigid cylinder, a sheet and the like.

The thickness of the substrate layer depends on numerous factors, including strength desired and economical considerations. Thus, this layer for a flexible belt may be of substantial thickness, for example, about 125 micrometers, or of minimum thickness less than 50 micrometers, provided there are not adverse effects on the final electrostatographic device.

The conductive layer may vary in thickness over substantially wide ranges depending on the optical transparency and degree of flexibility desired for the electrostatographic member. Accordingly, for a flexible photoresponsive imaging device, the thickness of the conductive layer may be between about 20 Angstrom units to about 750 Angstrom units, and more preferably from about 100 Angstrom units to about 200 Angstrom units for an optimum combination of electrical conductivity, flexibility and light transmission. The flexible conductive layer may be an electrically conductive metal layer formed, for example, on the substrate by any suitable coating technique, such as a vacuum depositing technique. Typical metals include aluminum, zirconium, niobium, tantalum, vanadium and hafnium, titanium, nickel, stainless steel, chromium, tungsten, molybdenum, and the like. In general, a continuous metal film can be attained on a suitable substrate, e.g. a polyester web substrate such as Mylar available from E. I. du Pont de Nemours & Co. with magnetron sputtering.

If desired, an alloy of suitable metals may be deposited. Typical metal alloys may contain two or more metals such as zirconium, niobium, tantalum, vanadium and hafnium, titanium, nickel, stainless steel, chromium, tungsten, molybdenum, and the like, and mixtures thereof. A typical electrical conductivity for conductive layers for electrophotographic imaging members in slow speed copiers is about $10^2$ to $10^3$ ohms/square centimeter.

After formation of an electrically conductive surface, an optional charge blocking layer or barrier layer may be applied thereto for photoreceptors. Generally, electron blocking layers for positively charged photoreceptors allow holes from the imaging surface of the photoreceptor to migrate toward the conductive layer. Any suitable blocking layer capable of forming an electronic barrier to holes between the adjacent photoconductive layer and the underlying conductive layer may be utilized. The blocking layer may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylaminoethylamino)titanate, isopropyl trianthranil titanate, isopropyl tri(N,N-dimethyl-ethylamino)titanate, titanium-4-amino benzene sulfonate oxyacetate, titanium 4-aminobenzoate isostearate oxyacetate, $[H_2N(CH_2)_4]CH_3Si(OCH_3)_2$, (gamma-aminobutyl) methyl diethoxysilane, and $[H_2N(CH_2)_3]CH_3Si(OCH_3)_2$ (gamma-aminopropyl) methyl diethoxysilane, as disclosed in U.S. Pat. Nos. 4,338,387, 4,286,033 and 4,291,110. The disclosures of U.S. Pat. Nos. 4,338,387, 4,286,033 and 4,291,110 are incorporated herein in their entirety. A preferred blocking layer comprises a reaction product between a hydrolyzed silane and the oxidized surface of a metal ground plane layer. The blocking layer may be applied by any suitable conventional technique such as spraying, dip coating, draw bar coating, gravure coating, silk screening, air knife coating, reverse roll coating, vacuum deposition, chemical treatment and the like. The blocking layer should be continuous and have a thickness of less than about 0.2 micrometer because greater thicknesses may lead to undesirably high residual voltage. A charge blocking layer is normally not employed when the charge transport layer is located between the substrate and the charge generating layer.

An optional adhesive layer may applied to the hole blocking layer or conductive layer. Any suitable adhesive layer well known in the art may be utilized. Typical adhesive layer materials include, for example, polyesters, duPont 49,000 (available from E.I. duPont de Nemours and Company), Vitel PE100 (available from Goodyear Tire & Rubber), polyurethanes, and the like. Satisfactory results may be achieved with adhesive layer thickness between about 0.05 micrometer (500 Angstroms) and about 0.3 micrometer (3,000 Angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infrared radiation drying, air drying and the like.

The pigment in the generator layer comprises mainly polymorphs of crystalline oxytitanium phthalocyanine or structural derivative thereof, whose structure is represented by formula (I)

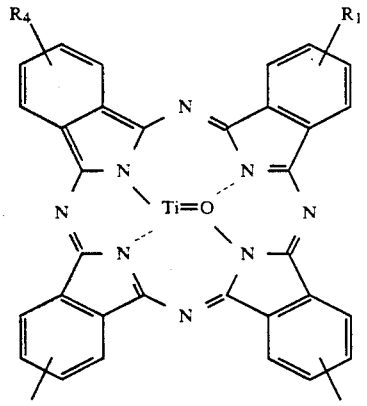

(1)

and wherein $R_1$, $R_2$, $R_3$, and $R_4$ are independently selected from the group consisting of hydrogen, alkyl, aryl, arylalkyl, sulfonic acid, alky or aryl sulfonate ester, and alky or aryl sulfonamide.

A variety of techniques may be used to prepare oxytitanyl phthalocyanine compounds and derivatives thereof as for example as described in copending applications, for example: U.S. Ser. No. 537,714 entitled PHOTOCONDUCTIVE IMAGING MEMBERS WITH TITANIUM PHTHALOCYANINE, filed Jun. 14, 1990; U.S. Ser. No. 533,265, filed Jun. 4, 1990; U.S. Ser. No. , filed Apr. 11, 1991; U.S. Ser. No. 678,506 entitled TITANIUM PHTHALOCYANINES AND PROCESSES FOR THE PREPARATION THEREOF, filed Apr. 1, 1991; and U.S. Ser. No. , filed Apr. 11, 1991, entitled TITANIUM PHTHALOCYANINES AND PROCESSES FOR THE PREPARATION THEREOF, filed Apr. 11, 1991, the disclosures of which are incorporated herein by reference in their entirety. Particularly preferred titanyl phthalocyanine polymorphs are Type I and Type IV.

Multi-photogenerating layer compositions may be utilized where a photoconductive layer enhances or reduces the properties of the photogenerating layer. Examples of this type of configuration are described in U.S. Pat. No. 4,415,639, the disclosure of this patent being incorporated herein by reference in its entirety. Any suitable polymeric film forming binder material may be employed as the matrix in the photogenerating binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloridevinylchloride copolymers, vinylacetate-vinylidenechloride copolymers, styrene-alkyd resins, polyvinylcarbazole, and the like. These polymers may be block, random or alternating copolymers. Particularly preferred organic polymeric film forming binders include charge transporting polymers for example polyether carbonates as disclosed for example in U.S. Pat. Nos. 4,801,517, 4,806,443, 4,806,444, 4,818,650 and 5,030,532 and polysilylenes as disclosed for example in U.S. Pat. Nos. 4,839,451 and 4,618,551, the disclosures of which are incorporated herein by reference in their entirety.

The photogenerating composition or pigment is present in the resinous binder composition in various amounts, generally, however, from about 10 percent by volume to about 90 percent by volume of the photogenerating pigment is dispersed in about 90 percent by volume to about 10 percent by volume of the resinous binder, and preferably from about 20 percent by volume to about 40 percent by volume of the photogenerating pigment is dispersed in about 80 percent by volume to about 60 percent by volume of the resinous binder composition.

The photogenerating layer containing photoconductive pigments and the resinous binder material generally ranges in thickness of from about 0.1 micrometer to about 5 micrometers, and preferably has a thickness of from about 0.2 micrometer to about 1 micrometer. The photogenerating layer thickness is related to binder content. Higher binder content compositions generally require thicker layers for photogeneration. Thicknesses outside these ranges can be selected providing the objectives of the present invention are achieved.

While there is no particular restriction on the mixing ratio between the oxytitanium phthalocyanine and the binder polymer, the binder polymer is generally used in an amount from 5 to 500 parts by weight, preferably, from 10 to 50 parts by weight based on 100 parts by weight of the oxytitanium phthalocyanine compound.

Any suitable and conventional technique may be utilized to mix and thereafter apply the photogenerating layer coating mixture. Typical application techniques include spraying, dip coating, roll coating, wire wound rod coating, and the like. Drying of the deposited coating may be effected by any suitable conventional technique such as oven drying, infrared radiation drying, air drying and the like.

Any suitable charge transporting polymer having active moieties incorporated in the backbone of the polymer whereby the charge is transported through the active moieties incorporated in the backbone of the polymer. Preferably, two distinct classes of charge transporting polymers having active moieties incorporated in the backbone of the polymer are utilized in the charge transporting layer of this invention. The first is a class of condensation polymers containing arylamine compounds incorporated in the back bone and the second class is polysilylenes. These electrically active charge transporting polymeric materials should be capable of supporting the injection of photogenerated holes from the charge generation material and capable of allowing the transport of these holes therethrough. In both these classes of polymers charges are transported through the backbone of the polymer. Particularly preferred charge transport polymers are poly(arylamine carbonate) compounds and polysilylenes. The expression "charge transporting moieties" of the film forming charge transporting polymer as employed herein is defined as one of the "active" units or segments that support charge transport. Typical charge transporting polymers of the first class of condensation polymers containing arylamine compounds incorporated in the back bone include arylamine compounds are represented by the formula:

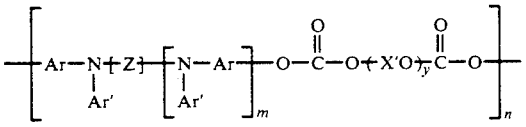

wherein n is between about 5 and about 5,000, z is selected from the group consisting of:

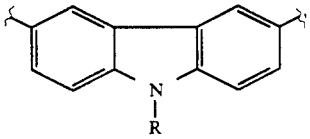

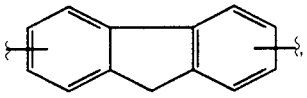

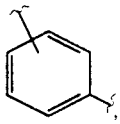

-continued

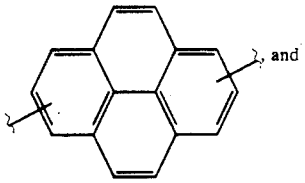

$\vdash Ar-(X)_n-Ar \dashv$ n is 0 or 1, Ar is selected from the group consisting of:

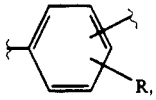

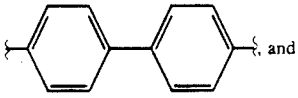

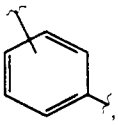

R is an alkylene radical selected from the group consisting of alkylene and iso-alkylene groups containing 2 to 10 carbon atoms, Ar′ is selected from the group consisting of:

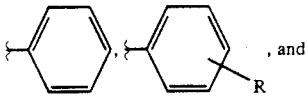

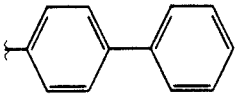

X is selected from the group consisting of:

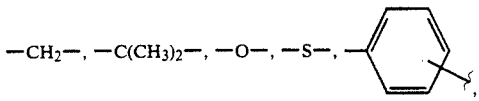

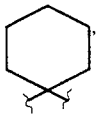

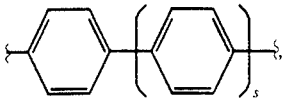

-continued

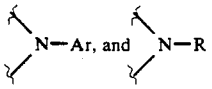

s is 0, 1 or 2, and X' is an alkyl radical selected from the group consisting of alkyl and iso-alkyl groups containing 2 to 10 carbon atoms.

A typical charge transporting polymer represented by the above formula is:

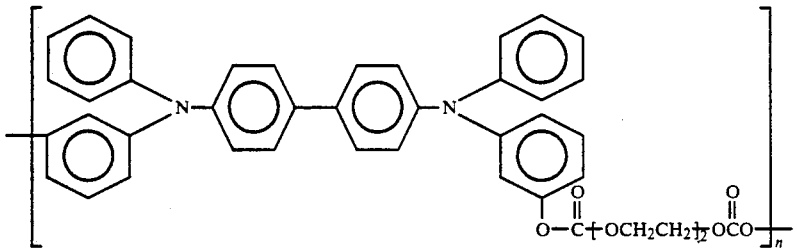

wherein the value of n is between about 10 and about 1,000. This and other charge transporting polymers represented by the above generic formula are described in U.S. Pat. No. 4,806,443, the entire disclosure thereof being incorporated herein by reference.

Other typical charge transporting polymers include arylamine compounds represented by the formula:

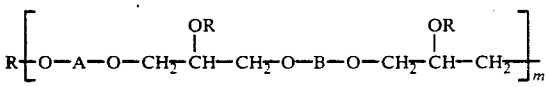

wherein:

R is selected from the group consisting of —H, —$CH_3$, and —$C_2H_5$;

m is between about 4 and about 1,000; and

A is selected from the group consisting of an arylamine group represented by the formula:

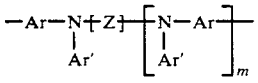

wherein:

m' is 0 or 1,

Z is selected from the group consisting of:

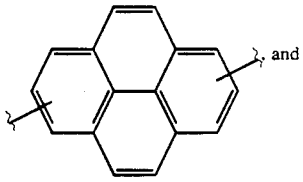

—Ar—$(X)_n$—Ar—

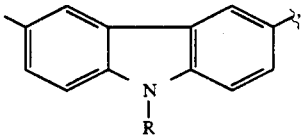

-continued

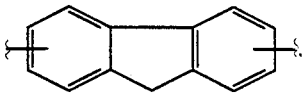

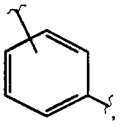

wherein:

n is 0 or 1,

Ar is selected from the group consisting of:

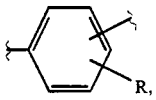

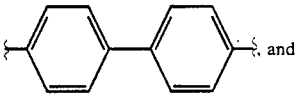

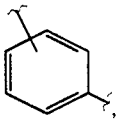

wherein:

R' is selected from the group consisting of —$CH_3$, —$C_2H_5$, —$C_3H_7$, and —$C_4H_9$, Ar' is selected from the group consisting of:

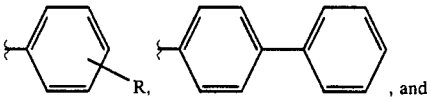

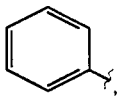

X is selected from the group consisting of:

—$CH_2$—, —$C(CH_3)_2$—, —O—, —S—, 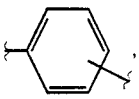

-continued

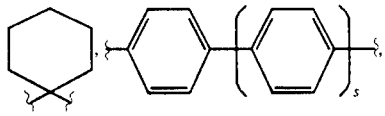

-continued

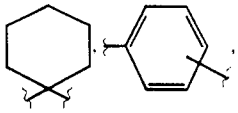

and n is 0 or 1. Specific examples include:

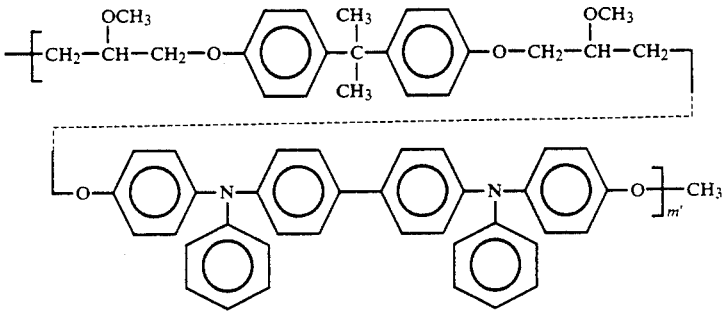

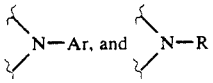

B is selected from the group consisting of: the arylamine group as defined for A, and $$-Ar-(V)_n-Ar-$$

wherein Ar is as defined above, and V is selected from the group consisting of:

$$-CH_2-,\ -C(CH_3)_2-,\ -O-,\ -S-,$$

where the value of m′ was between about 18 and about 19 and where the value of m″ was between about 4 and about 5. These and other charge transporting polymers represented by the above generic formula are described in U.S. Pat. No. 4,818,650 and U.S. Pat. No. 4,956,440, the entire disclosures thereof being incorporated herein by reference.

An example of still other typical charge transporting polymers is:

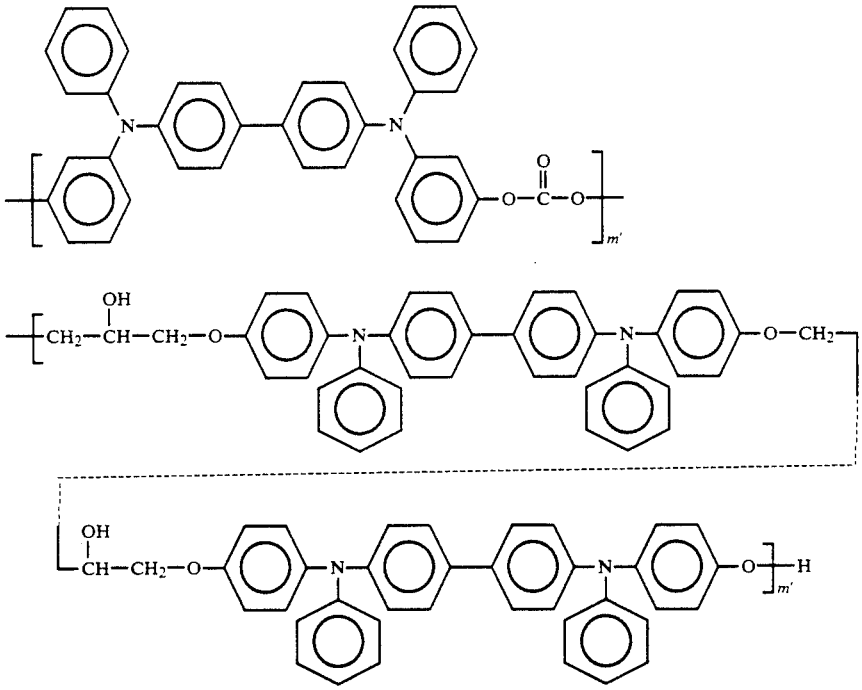

wherein the value of m′ was between about 10 and about 50. This and other related charge transporting polymers are described in U.S. Pat. No. 4,806,444 and U.S. Pat. No. 4,956,487, the entire disclosures thereof being incorporated herein by reference.

Other examples of typical charge transporting polymers are:

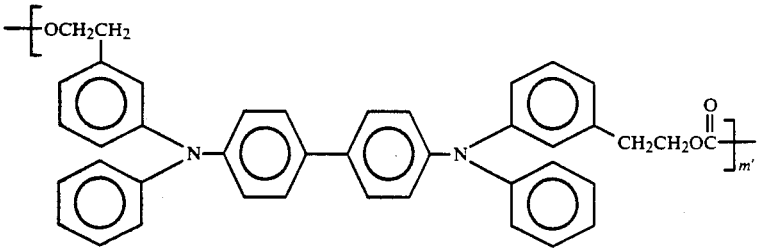

wherein m' is between about 10 and about 10,000 and

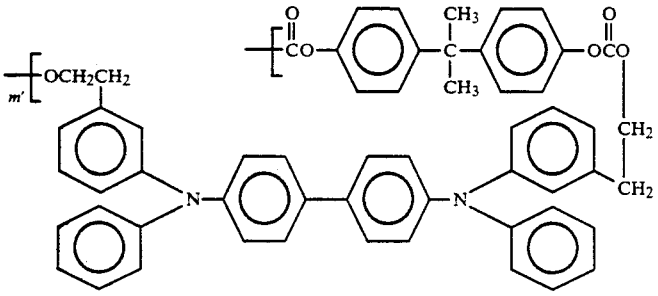

wherein m' is between about 10 and about 1,000. Related charge transporting polymers include copoly [3,3'bis(hydroxyethyl)triphenylamine/bisphenol A]carbonate, copoly [3,3'bis(hydroxyethyl)tetraphenylbezidine/bisphenol A]carbonate, poly[3,3'bis(hydroxyethyl)tetraphenylbenzidine]carbonate, poly [3,3'bis(hydroxyethyl)triphenylamine]carbonate, and the like. These charge transporting polymers are described in U.S. Pat. No. 4,401,517, the entire disclosure thereof being incorporated herein by reference.

Further examples of typical charge transporting polymers include:

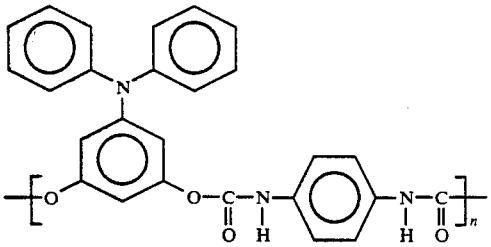

where n is between about 5 and about 5,000;

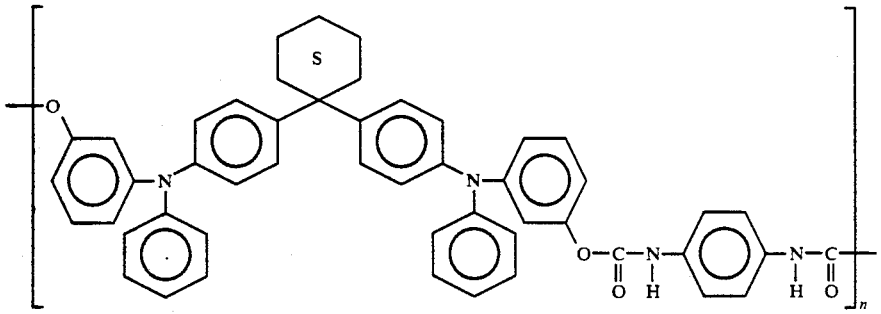

where n represents a number sufficient to achieve a weight average molecular weight of between about 20,000 and about 500,000;

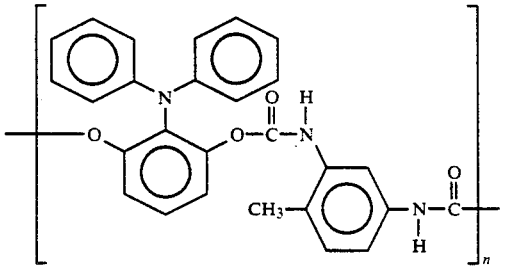

where n represents a number sufficient to achieve a weight average molecular weight of between about 20,000 and about 500,000; and

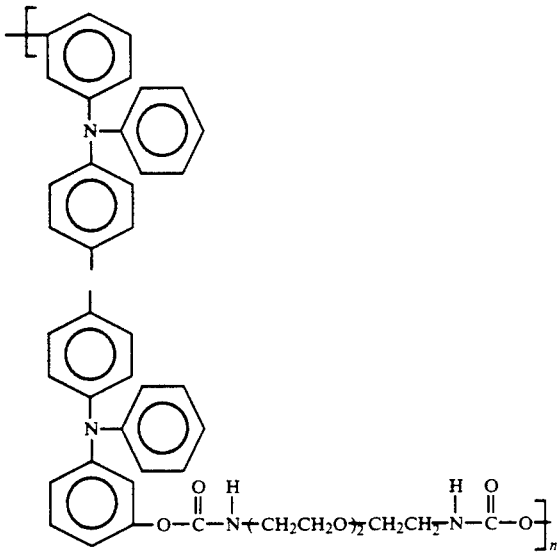

where n represents a number sufficient to achieve a weight average molecular weight of between about 20,000 and about 500,000. These and other related charge transporting polymers are described in copending U.S. Ser. No. 07/512,231 filed Apr. 20, 1990, and issued Jul. 9, 1991 the entire disclosure thereof being incorporated herein by reference.

Still other typical charge transporting polymers of the first class of condensation polymers containing arylamine compounds incorporated in the back bone include arylamine compounds are disclosed in copending application Ser. No. 797,753, D/89429), entitled "ELECTROPHOTOGRAPHIC IMAGING MEMBER", filed in the name of Yanus et al, mailed to the U.S. Patent and Trademark Office by Express Mail on Nov. 25, 1991. This material is useful in fabricating a charge transport layer of photosensitive members and comprises a polyarylamine polymer represented by the following formula:

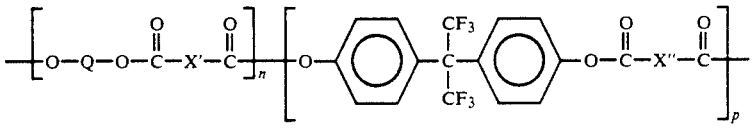

wherein:

n is between about 5 and about 5,000 p is between about 5 and about 5,000

X' and X'' are independently selected from a group having bifunctional linkages, and Q is a divalent group derived from certain hydroxy terminated arylamine reactants.

Another typical charge transporting polymer of the first class of condensation polymers containing arylamine compounds incorporated in the back bone are disclosed in copending application Ser. No. 798,308, entitled "ELECTROPHOTOGRAPHIC IMAGING MEMBERS CONTAINING POLYARYLAMINE POLYMERS", filed in the name of Yanus et al, mailed to the U.S. Patent and Trademark Office by Express Mail on Nov. 25, 1991. This material is also useful in fabricating a charge transport layer of photosensitive members and comprises a polyarylamine polymer represented by the following formula:

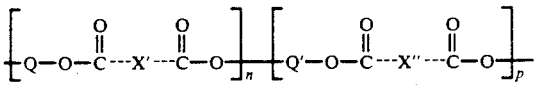

wherein:

n is between about 5 and about 5,000 p is between about 0 and about 5,000

X' and X'' are independently selected from a group having bifunctional linkages, Q is a divalent group derived from certain hydroxy terminated arylamine reactants, and Q' is a divalent group derived from a hydroxy terminated group.

The entire disclosures of these two recently filed applications are incorporated herein by reference.

Another typical charge transporting polymer of the first class of condensation polymers containing arylamine compounds incorporated in the back bone is disclosed in U.S. Pat. No. 5,030,532 issued Jul. 9, 1991 and is represented by the formula:

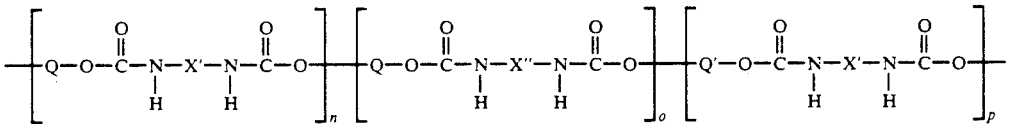

wherein:

n is between about 5 and about 5,000, or 0 if p>0, o is between about 0 and about 5,000, or is 0 if p>0 or n=0, p is between about 2 and about 100, or is 0 if n>0, X' and X'' are independently selected from a group having bifunctional linkages, Q is a divalent group derived from certain hydroxy terminated arylamine reactants, Q' is a divalent group derived from a hydroxy terminated polyarylamine containing the group defined for Q and having a weight average molecular weight between about 1000 and about 80,000 and the weight average molecular weight of the polyarylamine polymer is between about 10,000 and about 1,000,000;

The second class of charge transporting polymers are represented by the formula:

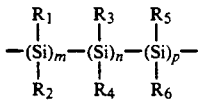

wherein $R_1$, $R_2$, $R_3$, $R_4$, $R_5$, and $R_6$ are independently selected from the group consisting of alkyl, aryl, substituted alkyl, substituted aryl, and alkoxy; and m, n, and p are numbers that reflect the percentage of the particular monomer unit in the total polymer composition with the sum of m plus n plus p being equal to 100 percent. Specifically thus, for example, zero percent is less than, or equal to n, and n is less than or equal to 100 percent; and zero percent is less than, or equal to p, and p is less than, or equal to 100 percent; and zero is less than, or equal to p, and p is less than, or equal to 100 percent. Any of the monomer units of the polysilylene can be randomly distributed throughout the polymer, or may alternatively be in blocks of varying lengths.

Some illustrative examples of the polysilylene transport layers include poly(methylphenyl silylene), poly(methylphenyl silylene-co-dimethyl silylene), poly(cyclohexylmethyl silylene), poly(tertiary-butylmethyl silylene), poly(phenylethyl silylene), poly(n-propylmethyl silylene), poly(p-tolylmethyl silylene), poly(cyclotrimethylene silylene), poly(cyclotetramethylene silylene), poly(cyclopentamethylene silylene), poly(di-t-butyl silylene-co-di-methyl silylene), poly(diphenyl silylene-co-phenylmethyl silylene), poly(cyanoethylmethyl silylene), which polysilylenes generally have a weight average molecular weight of from about 100,000 to about 2,000,000.

The polymer transport layer can have plasticizing or antioxidant additives of as much as 10 weight per cent by weight of the total layer.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infrared radiation drying, air drying and the like.

Generally, the thickness of the hole transport layer is between about 10 and about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layer is preferably maintained from about 2:1 to 200:1 and in some instances as great as 400:1. In other words, the charge transport layer, is substantially nonabsorbing to visible light or radiation in the region of intended use but is "active" in that it allows the injection of photogenerated holes from the photoconductive layer, i.e., charge generation layer, and allows these holes to be transported through the active charge transport layer to selectively discharge a surface charge on the surface of the active layer.

The photoreceptors of this invention may comprise, for example, a charge generator layer sandwiched between a conductive surface and a charge transport layer as described above or a charge transport layer sandwiched between a conductive surface and a charge generator layer. This structure may be imaged in the conventional xerographic manner which usually includes charging, activating radiation exposure, development, transfer, cleaning and recycling.

Other layers may also be used such as conventional electrically conductive ground strip along one edge of the belt or drum in contact with the conductive layer, blocking layer, adhesive layer or charge generating layer to facilitate connection of the electrically conductive layer of the photoreceptor to ground or to an electrical bias. Ground strips are well known and usually comprise conductive particles dispersed in a film forming binder.

Optionally, an overcoat layer may also be utilized to enhance resistance to abrasion. In some cases an anti-curl back coating may be applied to the side opposite the photoreceptor to provide flatness and/or abrasion resistance. These overcoating and anti-curl back coating layers are well known in the art and may comprise thermoplastic organic polymers or inorganic polymers that are electrically insulating or slightly semi-conductive. Overcoatings are continuous and generally have a thickness of less than about 10 micrometers.

The devices employing the combination of generator layer and polymeric transport layer of this invention exhibit numerous advantages such as extremely high sensitivities. Moreover, high sensitivities are maintained during cycling in a machine employing liquid development systems. Devices containing oxytitanium generators of the prior art are generally not useful in the liquid ink environment for the aforementioned reasons.

This imaging member of the instant invention may be employed in an electrophotographic imaging process comprising: a) providing an electrophotographic imaging member comprising: a supporting substrate; an optional blocking barrier layer; an optional adhesive layer; a charge generating layer comprising a crystalline titanium phthalocyanine compound represented by the aforementioned formula (I) dispersed in a binder wherein the binder is optionally a charge transporting polymer; and a charge transport layer, the charge transport layer comprising a film forming charge transporting polymer, the charge transporting polymers being selected from the group consisting of polysilylene represented by the aforementioned formula (II) and a polyarylamine derivative; (b) depositing a uniform electrostatic charge on the imaging member, (c) exposing the imaging member to activating radiation in image configuration to form an electrostatic latent image on the imaging member; (d) developing the electrostatic latent image with electrostatically attractable marking particles to form a toner image; (e) transferring the toner image to a receiving member; (f) cleaning; and (g) repeating the depositing, exposing, developing, transferring, and cleaning steps.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

An electrophotographic imaging member was prepared by forming coatings using conventional coating techniques on a substrate comprising vacuum deposited titanium layer on a polyethylene terephthalate film (Melinex ® available from ICI). The first coating was a siloxane barrier layer formed from hydrolyzed gamma aminopropyltriethoxysilane having a thickness of 0.005 micrometer (50 Angstroms). This film was coated as follows: 3-aminopropyltriethoxysilane (available from PCR Research Chemicals of Florida) was mixed in ethanol in a 1:50 volume ratio. The film was applied to a wet thickness of 0.5 mil by a multiple clearance film applicator. The layer was then allowed to dry for 5 minutes at room temperature, followed by curing for 10 minutes at 110 degree centigrade in a forced air oven. The second coating was an adhesive layer of polyester resin (49,000, available from E. I. duPont de Nemours & Co.) having a thickness of 0.005 microns (50 Angstroms) and was coated as follows: 0.5 grams of 49,000 polyester resin was dissolved in 70 grams of tetrahydrofuran and 29.5 grams of cyclohexanone. The film was coated by a 0.5 mil bar and cured in a forced air oven for 10 minutes. The next coating was a charge generator layer containing 75 percent by weight Type IV oxytitanium phthalocyanine particles, as obtained by the processes of the aforementioned copending applications and 25 wt. percent poly vinyl butyral resin, with a molecular weight of approximately 150,000 (BMS, available from Sekisui Chemical Co. of Japan). This layer was fabricated as follows: 0.56 gram of oxytitanium phthalocyanine particles and 0.18 gram of polyvinyl butyral were milled with 20 milliliters butyl acetate for 24 hours in a glass jar containing steel shot. A film of 0.2 micrometers was coated utilizing a 0.25 mil Bird bar and cured at 100 degrees centigrade for 10 minutes. The top coating was a 20 micrometer thick transport layer of polyether carbonate. It was coated with a solution containing one gram of charge transport polyether carbonate resin dissolved in 11.5 grams of methylene chloride solvent using a Bird coating applicator. The polyether carbonate resin was prepared as described in Example III of U.S. Pat. No. 4,806,443. This polyether carbonate resin is an electrically active charge transporting film forming binder and can be represented by the formula:

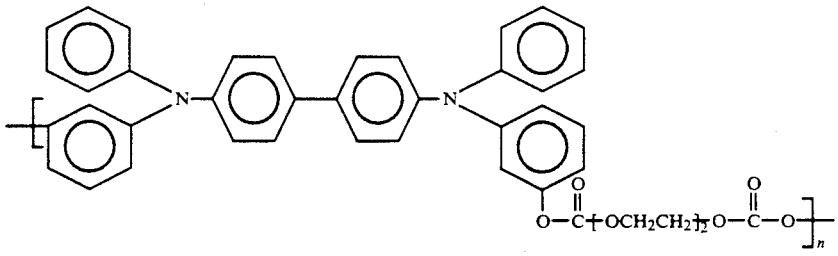

wherein n is about 300 in the above formula so that the molecular weight of the polymer is about 200,000. The film was dried in a forced air oven at 100° C. for 20 minutes. The device was mounted on a cylindrical aluminum drum which was rotated on a shaft. The film was charged by a corotron mounted along the circumference of the drum. The surface potential was measured as a function of time by several capacitively coupled probes placed at different locations around the shaft. The probes were calibrated by applying known potentials to the drum substrate. The film on the drum was exposed and erased by light sources located at appropriate positions around the drum. The measurement consisted of charging the photoconductor device in a constant current or voltage mode. As the drum rotated, the initial charging potential was measured by probe 1. Further rotation led to the exposure station, where the photoconductor device was exposed to monochromatic radiation of known intensity. The surface potential after exposure was measured by probes 2 and 3. The device was finally exposed to an erase lamp of appropriate intensity and any residual potential was measured by probe 4. The process was repeated with the magnitude of the exposure automatically changed during the next cycle. A photo induced discharge characteristics curve was obtained by plotting the potentials at probes 2 and 3 as a function of exposure. Extremely high sensitivities were observed in both the visible range (400–650 nanometers) and infrared range (700–780 nanometers). The optimum light energy required to generate a maximum contrast of 600 volts for 1.0 neutral density image was found to be 4 ergs/cm$^2$ in the visible and 2.5 ergs/cm$^2$ in the infrared range. The device was cycled continuously for 10,000 cycles of charge, expose and erase steps and found to have stable potentials during charging, after exposure and following erase steps.

EXAMPLE II

A layered photoreceptor was prepared by forming coatings using conventional techniques on a substrate comprising a vacuum deposited titanium layer on a polyethylene terephthalate film (Melinex ®, available from ICI). The first coating of a siloxane barrier layer, the second coating of the polyester and the third coating of the oxytitanium phthalocyanine generator layer were fabricated as described in Example I. The transport layer consisted of polymethyl phenyl silylene represented by the structure

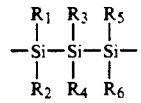

wherein $R_1$, $R_3$ and $R_5$, are methyl groups and $R_2$, $R_4$ and $R_6$ are phenyl groups. The transport layer was coated from a solution of two percent by weight of poly(methylphenylsilylene) in toluene. The device was heated in a vacuum oven maintained at 80° C. to form a dried coating having a thickness of 20 micrometers. The device was tested for its sensitivity, both in the visible and infrared, by the technique described in Example I. The optimum light energy required to generate a maximum contrast of 600 volts for 1.0 neutral density image was found to be 4 ergs/cm$^2$ in the visible and 2.5 ergs/cm$^2$ in the infrared range. The device was cycled continuously for 10,000 cycles of charge, expose and erase steps and found to have stable potentials during charging, after exposure and following erase steps.

COMPARATIVE EXAMPLE III

A layered photoreceptor was prepared by forming coatings using conventional techniques on a substrate comprising a vacuum deposited titanium layer on a polyethylene terephthalate film (Melinex®, available from ICI). The first coating of a siloxane barrier layer, the second coating of the polyester and the third coating of the oxytitanium phthalocyanine generator layer are fabricated as described in Example I. A 20 micrometer thick transport layer was coated with a solution containing one gram of N,N'-diphenyl-N,N'-bis(3-methyl-phenyl)-(1,1'-biphenyl)-4,4'-diamine and one gram of polycarbonate resin, a poly(4,4'-isopropylidenediphenylene carbonate), available under the trademark Makrolon® from Farbenfabricken Bayer A. G., dissolved in 11.5 grams of methylene chloride solvent using a Bird coating applicator. The N,N'-diphenyl-N,N'-bis(3-methyl-phenyl)-(1,1'-biphenyl)-4,4'-diamine is an electrically active aromatic diamine charge transport small molecule whereas the polycarbonate resin is an electrically inactive film forming binder. N,N'-diphenyl-N,N'-bis(3-methyl-phenyl)-(1,1'-biphenyl)-4,4'-diamine has the formula:

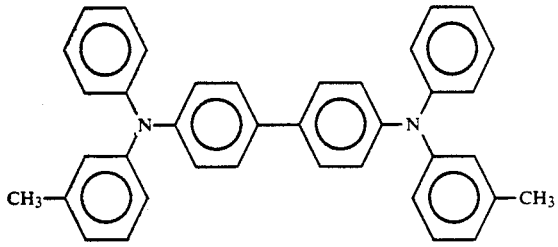

The film was dried in a forced air oven at 100° C. for 20 minutes. The device was tested for its sensitivity, both in the visible and Infra-red, by the technique described in Example 1. The optimum light energy required to generate a maximum contrast of 600 volts for 1.0 neutral density imagewise found to be 4 ergs/cm$^2$ in the visible and 2.5 ergs/cm$^2$ in the infrared range. The device was cycled continuously for 10,000 cycles of charge, expose and erase steps and found to have stable potentials during charging, after exposure and following erase steps.

EXAMPLE IV

The three devices essentially identical to those described in Examples I, II and III were fabricated with the exception that the Type IV oxytitanium phthalocyanine particles were replaced with the polymorph Type I oxytitanium phthalocyanine. On testing in the same manner as described in Example I, the sensitivity (600 volts contrast for neutral density of 1.0) in the visible spectrum was found to be 15 ergs/cm$^2$ for all three devices.

EXAMPLE V

The photoreceptor devices of Examples I, II and III were soaked in Isopar for 24 hours at 25 degrees C. This soaking was done to determine their resistance in machines employing liquid ink. The device in Example III containing-a 20 micrometer thick transport layer coated with a solution containing one gram of N,N'-diphenyl-N,N'-bis(3-methyl-phenyl)-(1,1'-biphenyl)-4,4'-diamine and one gram of polycarbonate resin, had a white residue resulting from leaching and crystallization of the active molecule N,N'-diphenyl-N,N'-bis(3-methyl-phneyl)-(1,1'-biphenyl)-4,4'-diamine. The devices in Example I and II were found to be physically unaffected. On retesting as described in Example I, the devices in Examples I and II showed that their sensitivity and cyclic stability was unchanged as a result of soaking in isopar. The device in Example III, however showed a high residual charge as a result of the Isopar soak.

EXAMPLE VI

Two electrophotographic imaging members were prepared by forming coatings using conventional coating techniques on a substrate comprising vacuum deposited titanium layer on a polyethylene terephthalate film (Melinex®, available from ICI). Both devices had the same substrate, conducting layer, blocking layer, adhesive layer and generator layers. The two devices had different charge transport layers. For both devices, the first coating was a siloxane barrier layer formed from hydrolyzed gamma aminopropyltriethoxysilane having a thickness of 0.005 micrometer (50 Angstroms). This film was coated as follows: 3-aminopropyltriethoxysilane (available from PCR Research Chemicals of Florida) was mixed in ethanol in a 1:50 volume ratio. The films were applied to a wet thickness of 0.5 mil by a multiple clearance film applicator. The layers were then allowed to dry for 5 minutes at room temperature, followed by curing for 10 minutes at 110 degree centigrade in a forced air oven. For both devices, the second coating was an adhesive layer of polyester resin (49,000, available from E. I. duPont de Nemours & Co.) having a thickness of 0.005 micrometer (50 Angstroms) and was coated as follows: 0.5 gram of 49,000 polyester resin was dissolved in 70 grams of tetrahydrofuran and 29.5 grams of cyclohexanone. The films were coated by a 0.5 mil bar and cured in a forced air oven for 10 minutes. For both devices, the next coating was a charge generator layer containing 85 percent by weight benzamidazole perylene particles and 15 wt. percent of polycarbonate resin [a poly(4,4'-isopropylidene-diphenylene) carbonate, available under the trademark Makrolon® from Farbenfabricken Bayer A. G.], and was fabricated as follows. 0.32 gram of benzamidazole perylene particles and 0.06 gram of polycarbonate resin were milled with 19 milliliters methylene chloride for 96 hours in a 2 ounce glass jar containing 100 grams ⅛ inch size steel shot. Films of about 0.4 micrometer thick were coated utilizing a 0.5 mil Bird bar and cured at 135 degree centigrade for 5 minutes.

The first generator film of benzamidazole perylene was coated with a 20 micrometer thick transport layer from a solution containing one gram of N,N'-diphenyl-N,N'-bis(3-methyl-phenyl)-(1,1'biphenyl)-4,4'-diamine (structure shown in Example III) and one gram of polycarbonate resin [a poly(4,4'-isopropylidene-diphenylene) carbonate, available under the trademark Makrolon® from Farbenfabricken Bayer A. G.], dissolved in 11.5 grams of methylene chloride solvent using a Bird coating applicator. The N,N'-diphenyl-N,N'-bis(3-methyl-phenyl)-(1,1'-biphenyl)-4,4'-diamine is an electrically active aromatic diamine charge transport small molecule whereas the polycarbonate resin is an electrically inactive film forming binder. The film was dried in a forced air oven at 100° C. for 20 minutes.

The second generator film of benzamidazole perylene was coated with a 20 microns thick transport layer of polyether carbonate (structure shown in Example I). It was coated with a solution containing one gram of polyether carbonate resin dissolved in 11.5 grams of methylene chloride solvent using a Bird coating applicator. The film was dried in a forced air oven at 100° C. for 20 minutes.

Both devices were tested for their sensitivity in the visible region by the technique described in Example I. The discharge shape, that is the potential versus exposure curve, for the first device, containing a molecularly dispersed transport layer is much more sensitive and steeper than for the second device containing the polymeric transport layer. Although not wanting to be limited by theory, it is believed that with benzamidazole perylene pigment, the penetration of the donor molecule from the transport layer into the generator layer is a requirement to produce very sensitive devices. The polymeric nature of the transport layer of the second device results in lowered sensitivity. This Example shows that a pigment that works well with a small molecule type (dispersed monomers in an inert matrix, polycarbonate) does not necessarily work well in conjunction with a transport layer consisting of a charge transporting polymer.

The following comparative examples demonstrate enhanced photosensitivity of the electrophotographic imaging member of the present invention compared to identically fabricated imaging members with the exception that the generating layer photogenerating pigment material is vanadyl phthalocyanine instead of titanyl phthalocyanine as in the present invention.

COMPARATIVE EXAMPLE VII

An electrophotographic imaging member was prepared by forming coatings using techniques as described in Example I on a substrate comprising vacuum depositing a titanium metal layer on a polyethylene terephthalate film (Melinex ®, available from ICI). The first coating was a siloxane barrier layer formed from hydrolyzed gamma aminopropyltriethoxysilane with a final thickness of 10 nanometers (100 Angstroms). The second coating was an adhesive layer of polyester resin (49,000, available from E. I. duPont de Nemours & Co.) with a final thickness of 5 nanometers (50 Angstroms). The next coating was a charge generator layer containing 35 percent by weight vanadyl phthalocyanine particles obtained by the process as disclosed in U.S. Pat. No. 4,771,133 (D/87041) to Liebermann et al., issued Sep. 13, 1988, dispersed in a polyester resin (Vitel PE100, available from Goodyear Tire and Rubber Co.) having a thickness of 1 micrometer. The top coating was a charge transport layer of polyether carbonate which structure is described in Example I. The process of transport layer coating is described in Example 1. The sensitivity was measured by the procedure as also described in Example I. The optimum light energy required to generate a maximum contrast of 600 volts for 1.0 neutral density image was found to be 18 ergs/cm$^2$ in the visible and 10 ergs/cm$^2$ in the infrared range. This device is considerably less sensitive than the device described in Example I.

COMPARATIVE EXAMPLE VIII

An electrophotographic imaging member was prepared by forming coatings using techniques as described in Example I on a substrate comprising vacuum depositing a titanium metal layer on a polyethylene terephthalate film (Melinex ®, available from ICI). The first coating was a siloxane barrier layer formed from hydrolyzed gammaaminopropyltriethoxysilane having a thickness of 10 nanometers (100 Angstroms). The second coating was an adhesive layer of polyester resin (49,000, available from E. I. duPont de Nemours & Co.) having a thickness of 5 nanometers (50 Angstroms). The next coating was a charge generator layer containing 35 percent by weight vanadyl phthalocyanine particles obtained by the process as disclosed in U.S. Pat. No. 4,771,133 (D/87041) to Liebermann et al., issued Sep. 13, 1988, dispersed in a polyester resin (Vitel PE100, available from Goodyear Tire and Rubber Co.) having a thickness of 1 micrometer. The top coating was a charge transport layer of polymethyl phenyl silylene which structure is described in Example II. The process of transport layer coating is described in Example II. The sensitivity was measured by the procedure described in Example I. The optimum light energy required to generate a maximum contrast of 600 volts for 1.0 neutral density image was found to be 18 ergs/cm$^2$ in the visible and 10 ergs/cm$^2$ in the infrared range. This device is considerably less sensitive than the device described in Example II.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. An electrophotographic imaging member comprising: a supporting substrate; an optional a charge blocking layer; an optional adhesive layer; a charge generating layer comprising a crystalline titanium phthalocyanine compound dispersed in a binder; and a charge transport layer comprising a film forming charge transporting polymer selected from the group consisting of polysilylene and polyarylamines.

2. An electrophotographic imaging member according to claim 1 wherein said crystalline titanium phthalocyanine compound is represented by formula (I)

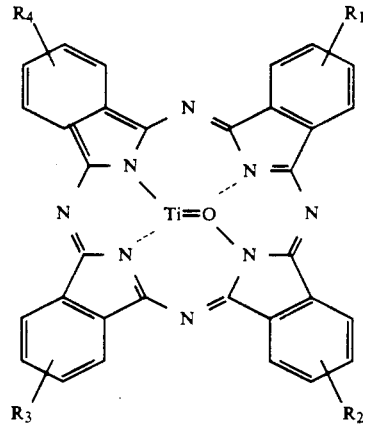

(I)

and wherein $R_1$, $R_2$, $R_3$, and $R_4$ are independently selected from the group consisting of hydrogen, alkyl, aryl, arylalkyl, sulfonic acid, alky or aryl sulfonate ester, and alky or aryl sulfonamide.

3. An electrophotographic imaging member according to claim 1 wherein said film forming polysilylene charge transporting polymer is represented by formula (II),

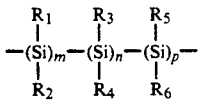

(II)

and wherein $R_1$, $R_2$, $R_3$, $R_4$, $R_5$, and $R_6$ are independently selected from the group consisting of alkyl, aryl, substituted alkyl, substituted aryl selected from the group consisting of alkyl aryl, amino aryl and hydroxy aryl, and alkoxy; and wherein m, n, and p are the percentages of silane monomer units in the total polymer where m+n+p=100 percent and a weight average molecular weight of from about 100,000 to about 2,000,000.

4. An electrophotographic imaging member according to claim 1 wherein said film forming charge transporting polymer is represented by formula (III)

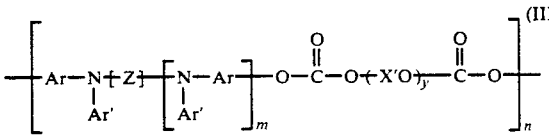

(III)

wherein n is between about 5 and about 5,000,

Z is selected from the group consisting of:

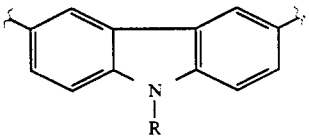

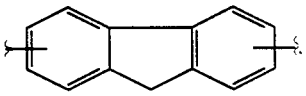

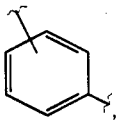

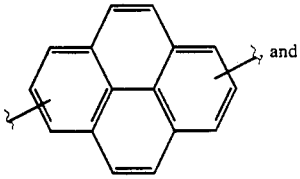

$\leftarrow Ar-(X)_n-Ar \rightarrow$ n is 0 or 1;

Ar is selected from the group consisting of:

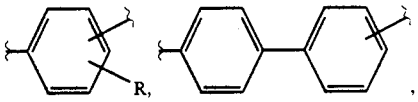

-continued

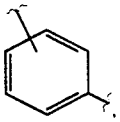

R is an alkyl radical selected from the group consisting of alkyl and iso-alkyl groups containing 2 to 10 carbon atoms, Ar' is selected from the group consisting of:

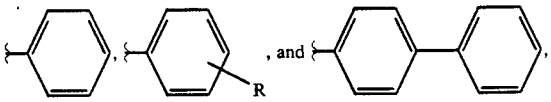

X is selected from the group consisting of:

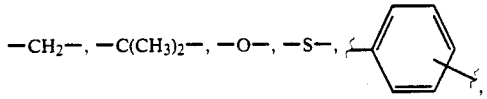

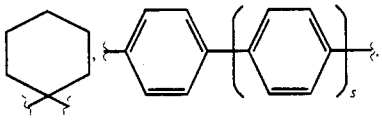

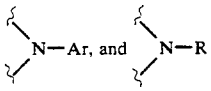

s is 0, 1 or 2, and

X' is an alkyl radical selected from the group consisting of alkyl and iso-alkyl groups containing 2 to 10 carbon atoms.

5. An imaging member according to claim 1 wherein the charge generator layer is between said substrate and said charge transport layer.

6. An electrophotographic imaging member according to claim 1 wherein said charge generator layer has a thickness of between about 0.05 micrometer and about 10 micrometers.

7. An electrophotographic imaging member according to claim 1 wherein the charge transport layer has a thickness of between about 5 micrometers and about 50 micrometers.

8. An electrophotographic imaging member according to claim 1 wherein the charge generating pigment is dispersed in a resinous binder in an amount of between about 5 percent by weight and about 95 percent by weight based on the total weight of said charge generating layer.

9. An imaging member according to claim 1 comprising a supporting substrate, a photogenerator layer comprising a titanyl phthalocyanine pigment, and a hole transport layer.

10. An imaging member in accordance with claim 1 wherein the imaging member is sensitive to light of a wavelength of from about 400 nanometers to about 800 nanometers.

11. An electrophotographic imaging member according to claim 1 wherein the binder of the charge generation layer is a charge transporting polymer selected from the group consisting of polysilyene and poly(arylamine carbonate) polymers.

12. An electrophotographic imaging process comprising:

a) providing an electrophotographic imaging member comprising: a supporting substrate; a charge generating layer comprising a crystalline titanium phthalocyanine compound represented by formula (I)

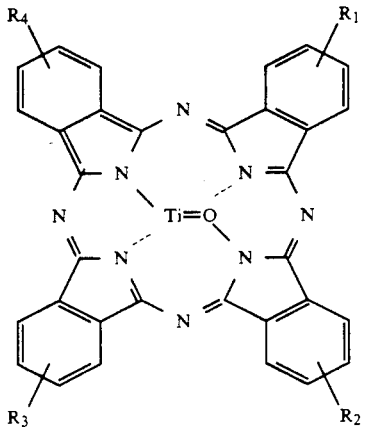

(I)

wherein $R_1$, $R_2$, $R_3$, and $R_4$ are selected from the group hydrogen, alkyl, aryl, arylalkyl, sulfonic acid, alky or aryl sulfonate ester, alky or aryl sulfonamide, dispersed in a binder wherein said binder is a charge transporting polymer; and a charge transport layer, said charge transport layer comprising a film forming charge transporting polymer selected from the group consisting of polysilylene and polyarylamines, (b) depositing a uniform electrostatic charge on said imaging member;

(c) exposing said imaging member to activating radiation in image configuration to form an electrostatic latent image on said imaging member;

(d) developing said electrostatic latent image with electrostatically attractable marking particles to form a toner image;

(e) transferring said toner image to a receiving member;

(f) cleaning; and (g) repeating said depositing, exposing, developing, cleaning and transferring steps.

13. An electrophotographic imaging process according to claim 12 wherein said charge transporting polymer is selected from the group consisting of polysilylene represented by formula (II),

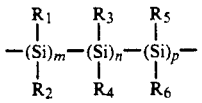

(II)

wherein $R_1$, $R_2$, $R_3$, $R_4$, $R_5$, and $R_6$ are independently selected from the group consisting of alkyl, aryl, substituted alkyl, substituted aryl selected from the group consisting of alkyl aryl, aminoaryl and hydroxy aryl, and alkoxy, and wherein m, n, and p are the percentages of silane monomer units in the total polymer where m+n+p=100 percent, and a poly (arylamine carbonate) represented by formula (III),

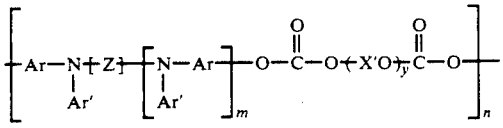

(III)

wherein n is between about 5 and about 5,000,

Z is selected from the group consisting of:

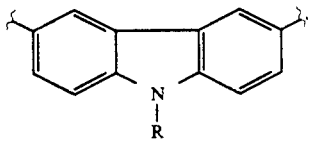

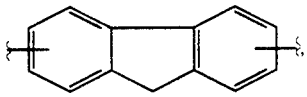

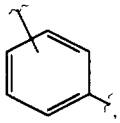

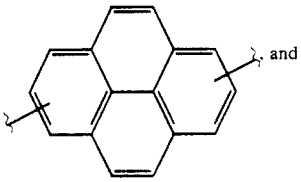

and $-Ar-(X)_n-Ar-$ n is 0 or 1,

Ar is selected from the group consisting of:

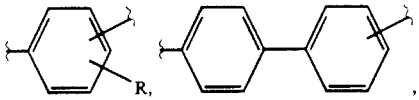

, and

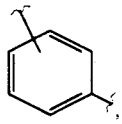

R is an alkyl radical selected from the group consisting of alkyl and iso-alkyl groups containing 2 to 10 carbon atoms, Ar' is selected from the group consisting of:

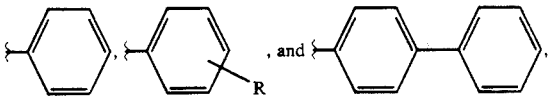

, and

X is selected from the group consisting of:

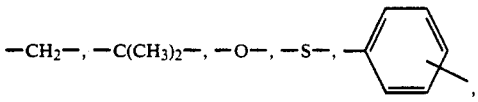

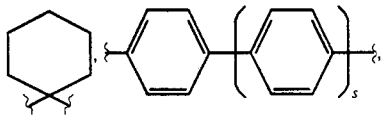

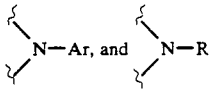

s is 0, 1 or 2, and

X′ is an alkyl radical selected from the group consisting of alkyl and iso-alkyl groups containing 2 to 10 carbon atoms, said charge transport layer being substantially free of electrically inactive film forming binder.

14. An electrophotographic imaging process according to claim 12 wherein said electrostatically attractable marking particles are suspended in a liquid carrier vehicle.

15. An electrophotographic imaging process according to claim 14 further comprising removing said liquid carrier vehicle from said imaging member following said developing and preceding said toner image transferring step.

16. An electrophotographic imaging process according to claim 12 wherein said activating radiation is radiation emitted from at least one solid state semiconductor diode.

17. An electrophotographic imaging process according to claim 12 wherein said binder for said crystalline titanium phthalocyanine compound is a charge transporting polymer.

18. An electrophotographic imaging process according to claim 17 wherein said binder for said crystalline titanium phthalocyanine compound is a film forming charge transporting polymer selected from the group consisting of polysilylene and polyarylamine derivative.

* * * * *